US012031538B2

(12) United States Patent
Genevois et al.

(10) Patent No.: US 12,031,538 B2
(45) Date of Patent: Jul. 9, 2024

(54) SCROLL COMPRESSOR INCLUDING A BASEPLATE HAVING A MOUNTING BASE AND A CYLINDRICAL RIM SECURED BY A DOUBLE-WELDED T-JOINT

(71) Applicant: Danfoss Commercial Compressors, Trevoux (FR)

(72) Inventors: David Genevois, Nordborg (DK); Remi Bou Dargham, Nordborg (DK); Cyril Montes, Nordborg (DK); Arnaud Daussin, Nordborg (DK); Dominique Gross, Nordborg (DK)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 278 days.

(21) Appl. No.: 17/423,555

(22) PCT Filed: Jan. 27, 2020

(86) PCT No.: PCT/EP2020/051869
§ 371 (c)(1),
(2) Date: Jul. 16, 2021

(87) PCT Pub. No.: WO2020/164891
PCT Pub. Date: Aug. 20, 2020

(65) Prior Publication Data

US 2022/0074412 A1 Mar. 10, 2022

(30) Foreign Application Priority Data

Feb. 13, 2019 (FR) ..... 1901452

(51) Int. Cl.
*F04C 23/00* (2006.01)
*F04C 18/02* (2006.01)
*F04C 23/02* (2006.01)

(52) U.S. Cl.
CPC ..... *F04C 23/008* (2013.01); *F04C 18/0253* (2013.01); *F04C 23/02* (2013.01);
(Continued)

(58) Field of Classification Search
CPC ..... F04C 18/0207; F04C 18/0253; F04C 2230/231; F04C 2240/30; F04C 2240/809; F04C 23/008; F04C 23/02
See application file for complete search history.

(56) References Cited

U.S. PATENT DOCUMENTS 8,002,528 B2 8/2011 Hodapp et al.
8,142,175 B2 * 3/2012 Duppert ..... F04C 23/001 417/363

(Continued)

FOREIGN PATENT DOCUMENTS

CN 201395365 Y 2/2010
CN 205822296 U 12/2016

(Continued)

OTHER PUBLICATIONS

International Search Report for PCT Serial No. PCT/EP2020/051869 dated Apr. 21, 2020.

(Continued)

*Primary Examiner* — Anthony Ayala Delgado
(74) *Attorney, Agent, or Firm* — McCormick, Paulding & Huber PLLC

(57) ABSTRACT

The scroll compressor (2) including a hermetic enclosure (3), a compression unit (11) configured to compress refrigerant, and an electric motor (16) configured to drive the compression unit (11) via a drive shaft (15), the hermetic enclosure (3) including a midshell (4), an upper cap (5) and a baseplate (6), the baseplate (6) including a mounting base (24) having a plate shape and including a central portion, and a cylindrical rim surrounding the central portion and (Continued)

extending upwardly, the cylindrical rim (28) being secured to the mounting base (24) by a double-welded T-joint (29), the double-welded T-joint (29) including an inner welding seam connecting an inner surface of the cylindrical rim (28) to the mounting base (24), and an outer welding seam connecting an outer surface of the cylindrical rim (28) to the mounting base (24).

20 Claims, 3 Drawing Sheets

(52) U.S. Cl.
CPC .... *F04C 2230/231* (2013.01); *F04C 2240/30* (2013.01); *F04C 2240/809* (2013.01)

(56) References Cited

U.S. PATENT DOCUMENTS 8,152,500 B2 * 4/2012 Beagle ..... F04C 23/008 418/55.1
11,168,686 B2 * 11/2021 Takai ..... F04C 18/0215
2009/0038150 A1 * 2/2009 Kishikawa ..... B23K 26/282 219/121.85
2009/0185927 A1 * 7/2009 Duppert ..... F01C 17/066 418/55.1
2009/0185932 A1 * 7/2009 Beagle ..... F01C 21/007 418/55.2
2016/0341199 A1 11/2016 Noh et al.
2018/0320519 A1 * 11/2018 Perisse ..... F01C 21/02

FOREIGN PATENT DOCUMENTS

| | | | |
|---|---|---|---|
| CN | 108799110 | A | 11/2018 |
| FR | 3065998 | A1 | 11/2018 |
| GB | 2 229 226 | B | 3/1991 |
| JP | H07158577 | A | 6/1995 |
| JP | H11-280670 | A | 10/1999 |

OTHER PUBLICATIONS

First Examination Report for Indian Patent Application No. 202117026621 dated Feb. 25, 2022.

* cited by examiner

SCROLL COMPRESSOR INCLUDING A BASEPLATE HAVING A MOUNTING BASE AND A CYLINDRICAL RIM SECURED BY A DOUBLE-WELDED T-JOINT

CROSS-REFERENCE TO RELATED APPLICATIONS

This application is a National Stage application of International Patent Application No. PCT/EP2020/051869, filed on Jan. 27, 2020, which claims priority to French Application No. 19/01452 filed on Feb. 13, 2019, each of which is hereby incorporated by reference in its entirety.

TECHNICAL FIELD

The present invention relates to a scroll compressor, and in particular to a scroll refrigeration compressor.

BACKGROUND

U.S. Pat. No. 8,142,175 discloses a scroll compressor comprising:

a hermetic enclosure comprising a midshell, an upper cap and a baseplate, the baseplate comprising a mounting base having a plate shape and including a central opening, and a central cap arranged within the central opening, the central cap comprising a concave portion and a cylindrical rim portion extending upwardly and having an outer diameter substantially corresponding to an inner diameter of the midshell, a compression unit configured to compress refrigerant, and an electric motor configured to drive the compression unit via a drive shaft.

The mounting base of the above-mentioned scroll compressor is secured to the central cap at a position radially inside the inner diameter of the midshell, and via an annular welding seam.

Such a configuration of the baseplate leads to vibration and noise problems, especially in manifolded systems, where at least two scroll compressors are mounted together on a common rail system. Particularly, in a manifolded system, the scroll compressors may be subjected to a rocking movement due to the small contact surface between the central cap and the mounting base.

In addition, the baseplate of the above-mentioned scroll compressor is relatively expensive to manufacture due to the mounting base and the central cap, which have to be manufactured by deep-drawing and stamping, and which have to be oriented and welded together with small tolerances to ensure proper sealing with the midshell. Further, the deep-drawing of the central cap portion of the baseplate leads to thickness variations, which have to be thoroughly controlled to satisfy the high pressure equipment standards.

SUMMARY

It is an object of the present invention to provide an improved scroll compressor which can overcome the drawbacks encountered in conventional scroll compressors.

Another object of the present invention is to provide a scroll compressor which substantially reduces vibration and noise problems, and which is cheaper to manufacture.

According to the invention such a scroll compressor comprises a hermetic enclosure, a compression unit configured to compress refrigerant, and an electric motor configured to drive the compression unit via a drive shaft, the hermetic enclosure comprising a midshell, an upper cap and a baseplate, the baseplate comprising a mounting base having a plate shape and including a central portion, characterized in that the baseplate further comprises a cylindrical rim surrounding the central portion and extending upwardly, the cylindrical rim being secured to the mounting base by a double-welded T-joint, the double-welded T-joint including an inner welding seam connecting an inner surface of the cylindrical rim to the mounting base, and an outer welding seam connecting an outer surface of the cylindrical rim to the mounting base.

Due to the simple parts forming the baseplate according to the present invention, i.e. the plate-shaped mounting base and the cylindrical rim, the manufacturing costs of the baseplate can be kept low, even that two welding seams are required to connect the mounting base and the cylindrical rim.

Further, the baseplate according to the present invention can be manufactured with less mechanical deformation and mechanical working than prior art baseplates which particularly include cup shaped central caps manufactured by deep-drawing and stamping. This leads to less thickness variations of the baseplate and thus higher compressor reliability.

In addition, the baseplate according to the present invention allows a more stable mounting of the scroll compressor due to the double-welded T-joint connecting the mounting base and the cylindrical rim and particularly due to the important contact area between the mounting base and the cylindrical rim formed by the inner welding seam and the outer welding seam. Therefore, the baseplate according to the present invention satisfies the requirements of the high pressure equipment standards, and it reduces the risk of rocking movements of the scroll compressor. At the same time, the natural frequency of the entire scroll compressor equipped with the baseplate is shifted to a higher level, which reduces noise and vibration issues.

The scroll compressor may also include one or more of the following features, taken alone or in combination.

According to an embodiment of the invention, the cylindrical rim and the midshell are concentrically arranged.

According to an embodiment of the invention, the cylindrical rim extends substantially perpendicularly to an upper surface of the mounting base.

According to an embodiment of the invention, each of the inner welding seam and the outer welding seam is annular.

According to an embodiment of the invention, the inner and outer welding seams are concentrically arranged.

According to an embodiment of the invention, the cylindrical rim is secured to the midshell by welding.

According to an embodiment of the invention, the cylindrical rim is secured to the midshell by lap welding.

According to an embodiment of the invention, a lower end portion of the midshell overlaps and surrounds the outer surface of the cylindrical rim.

According to an embodiment of the invention, a lower end portion of the midshell overlaps the inner surface of the cylindrical rim and is surrounded by the cylindrical rim.

According to an embodiment of the invention, the scroll compressor includes an annular lap joint welding seam securing the midshell to the cylindrical rim.

According to an embodiment of the invention, the annular lap joint welding seam connects a lower edge of the midshell to the cylindrical rim, and for example to the outer surface of the cylindrical rim.

According to an embodiment of the invention, the annular lap joint welding seam connects an upper edge of the cylindrical rim to the midshell, and for example to the outer surface of the midshell.

According to an embodiment of the invention, the midshell, and particularly the lower end portion of the midshell, has an outer diameter which corresponds substantially to an outer diameter of the cylindrical rim, the midshell being secured to the cylindrical rim by a welded butt joint, i.e. by butt welding.

According to an embodiment of the invention, the welded butt joint includes an annular butt joint welding seam connecting a lower edge of the midshell to an upper edge of the cylindrical rim.

According to an embodiment of the invention, the welded butt joint comprises an inner cylindrical support ring arranged within the hermetic casing and overlapping a butt joint area.

According to an embodiment of the invention, the central portion of the mounting base has a concave shape to accommodate an oil sump formed at the bottom of the hermetic compressor volume and/or an oil pump attached to the lower end of the drive shaft.

According to an embodiment of the invention, the baseplate is configured to be mounted on two mounting rails extending substantially parallely to each other.

According to an embodiment of the invention, the mounting base, and for example the central portion of the mounting base, is provided with two indentations configured to cooperate with and to at least partially receive the two mounting rails. Due to such a configuration of the mounting base, the total height of the scroll compressor can be reduced.

According to an embodiment of the invention, the distance between the two indentations substantially corresponds to the distance between the mounting rails.

According to an embodiment of the invention, each indentation has a shape which is at least partially complementary to the outer shape of the respective mounting rail.

According to an embodiment of the invention, the mounting base further comprises fastening holes to accommodate fastening elements, e.g. bolts or screws, to secure the mounting base on the mounting rails.

According to an embodiment of the invention, the scroll compressor further comprises at least one bracket secured to an inner surface of the midshell, e.g. by welding, and configured to support a lower bearing member rotatably supporting the drive shaft.

According to an embodiment of the invention, an upper axial end face of the cylindrical rim abuts against the at least one bracket, and for example against a lower axial end face of the at least one bracket. Particularly, the lower axial end face of the at least one bracket serves as a stop surface for the insertion of the baseplate into the midshell. Such a configuration of the baseplate allows mastering the vertical position of the baseplate in the midshell before welding the baseplate to the midshell, and thus eases the manufacturing of the scroll compressor.

According to an embodiment of the invention, the at least one bracket is L-shaped.

According to an embodiment of the invention, the scroll compressor includes a plurality of brackets secured to the inner surface of the midshell. Advantageously, the brackets are angularly arranged around the drive shaft.

According to an embodiment of the invention, the mounting base has a generally rectangular shape, and for example a square shape, and includes four lateral outer edges and four downwardly bent flanges each extending from and along a respective one of the four lateral outer edges.

According to an embodiment of the invention, a first pair of said four downwardly bent flanges is configured to extend substantially parallely to the two mounting rails and a second pair of said four downwardly bent flanges is configured to extend transversally to the two mounting rails.

According to an embodiment of the invention, each downwardly bent flange of the second pair may only extend along a central part of the respective lateral outer edge. Such a configuration enables mounting of several scroll compressors on a rail system comprising the two mounting rails.

According to an embodiment of the invention, the midshell may have a constant diameter over its entire length, or may have sections with different diameters.

According to an embodiment of the invention, the midshell is cylindrical and includes an upper end closed by the upper cap and a lower end closed by the baseplate.

According to an embodiment of the invention, the upper cap is welded to the midshell.

According to an embodiment of the invention, the compression unit is arranged within the hermetic enclosure.

According to an embodiment of the invention, the scroll compressor includes a lower bearing member and an upper bearing member configured to rotatably support the drive shaft.

According to an embodiment of the invention, the cylindrical rim extends substantially perpendicularly to the extension plane of the mounting base.

According to an embodiment of the invention, the cylindrical rim extends substantially vertically.

These and other advantages will become apparent upon reading the following description in view of the drawings attached hereto representing, as non-limiting examples, several embodiments of a scroll compressor according to the invention.

BRIEF DESCRIPTION OF THE DRAWINGS

The following detailed description of several embodiments of the invention is better understood when read in conjunction with the appended drawings being understood, however, that the invention is not limited to the specific embodiments disclosed.

DETAILED DESCRIPTION

Figure 1:
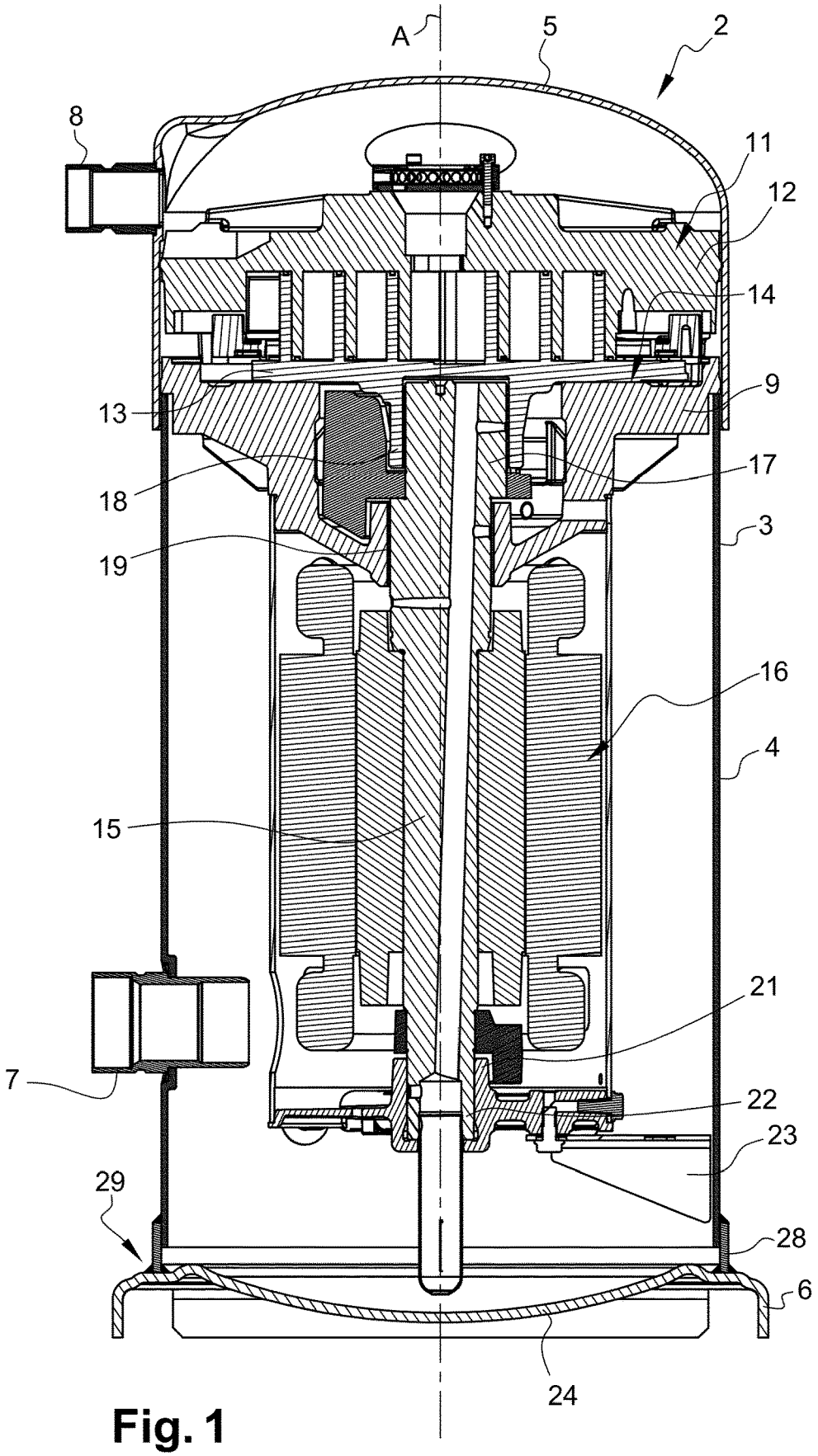
FIG. 1 is a longitudinal section view of a scroll compressor according to a first embodiment of the invention.

FIG. 1 shows a scroll compressor 2 comprising a hermetic enclosure 3 comprising a midshell 4, an upper cap 5 and a baseplate 6. As shown on FIG. 1, the midshell 4 is cylindrical and includes an upper end closed by the upper cap 5 and a lower end closed by the baseplate 6. According to the embodiment shown on the figures, the midshell 4 has a constant diameter over its entire length, and the upper cap 5 is welded to the midshell 4.

The scroll compressor 2 further comprises a suction inlet 7 configured to supply the scroll compressor 2 with refrigerant to be compressed, and a discharge outlet 8 configured to discharge compressed refrigerant. For example, the suction inlet 7 may be provided on the midshell 4 and the discharge outlet 4 may be provided on the upper cap 5.

The scroll compressor 2 also comprises a support frame 9 arranged within the hermetic enclosure 3 and secured to the hermetic enclosure 3, and a compression unit 11 also arranged within the hermetic enclosure 3 and disposed above the support frame 9. The compression unit 11 is configured to compress the refrigerant supplied by the suction inlet 7, and includes a fixed scroll 12, which is fixed in relation to the hermetic enclosure 3, and an orbiting scroll 13 supported by and in slidable contact with a thrust bearing surface 14 provided on the support frame 9.

Furthermore the scroll compressor 2 includes a drive shaft 15 configured to drive the orbiting scroll 13 in an orbital movement, and an electric motor 16, which may be a variable-speed electric motor, coupled to the drive shaft 15 and configured to drive in rotation the drive shaft 15 about a rotational axis A. According to the embodiment shown on the figures, the electric motor 16 is disposed below the support frame 9.

The drive shaft 15 comprises, at its upper end portion, an eccentric pin 17 which is eccentrically arranged in relation to the rotational axis A of the drive shaft 15, and which is inserted in a connecting sleeve part 18 provided on the orbiting scroll 13 so as to cause the orbiting scroll 13 to be driven in an orbital movement relative to the fixed scroll 12 when the electric motor 16 is operated.

The scroll compressor 2 further includes an upper bearing member 19 provided on the support frame 9 and configured to cooperate with an outer circumferential wall surface of the drive shaft 15, and a lower bearing member 21 configured to cooperate with an outer circumferential wall surface of a lower end portion 22 of the drive shaft 15. The lower bearing member 21 and the upper bearing member 19 are particularly configured to rotatably support the drive shaft 15.

Particularly, the scroll compressor 2 includes a plurality of brackets 23 secured to an inner surface of the midshell 4, e.g. by welding, and configured to support the lower bearing member 21. According to the embodiment shown on the figures, the brackets 23 are angularly arranged around the drive shaft 15, and each bracket 23 is L-shaped.

Figure 2:
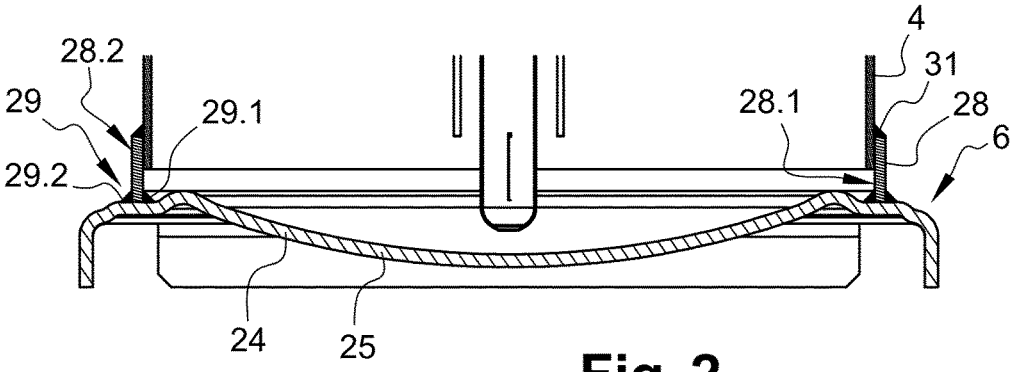
FIG. 2 is a partial longitudinal section view of the scroll compressor of FIG. 1.
Figure 3:
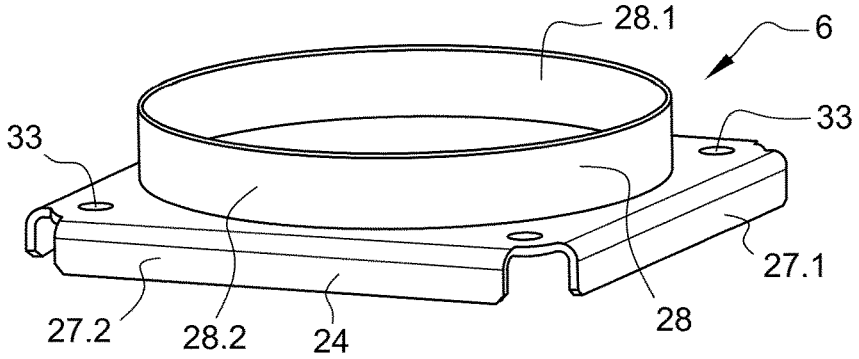
FIG. 3 is a perspective view of a baseplate of the scroll compressor of FIG. 1.
Figure 4:
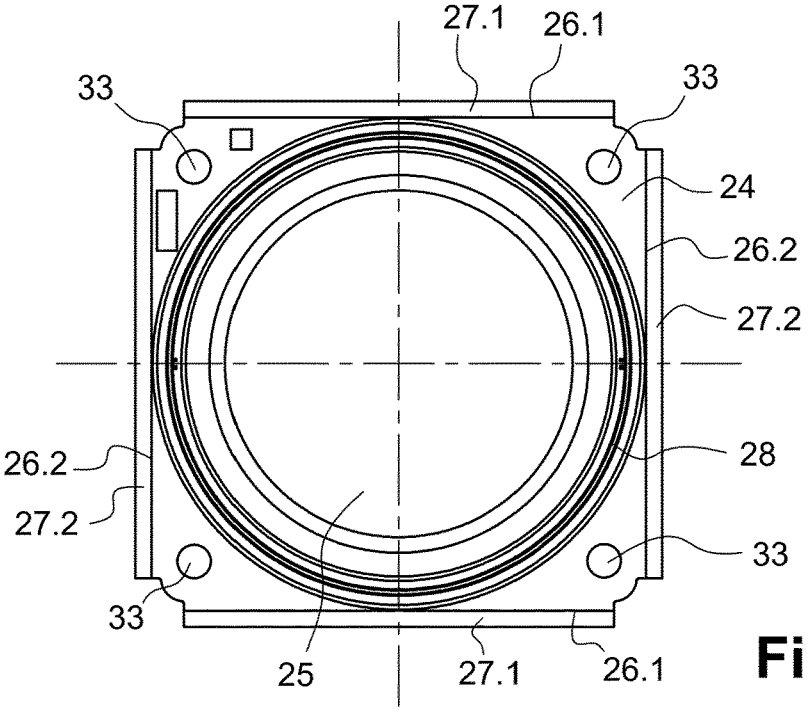
FIG. 4 is a top view of the baseplate of FIG. 3.
Figure 5:
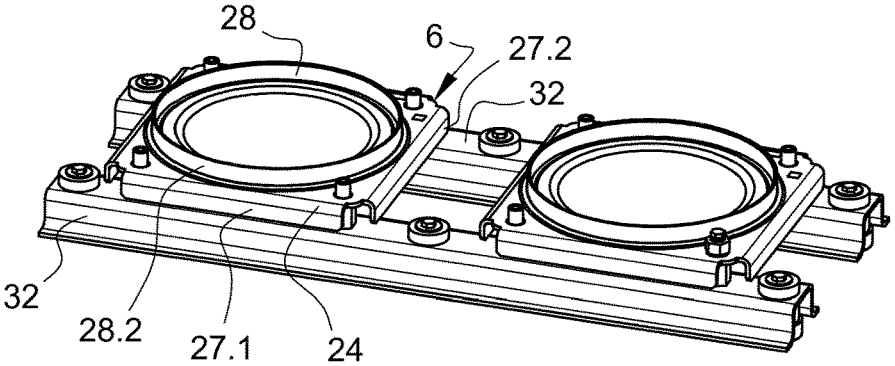
FIG. 5 is a perspective view of the baseplate of FIG. 3 mounted on two mounting rails.

As better shown on FIGS. 2 to 4, the baseplate 6 comprises a mounting base 24 having a plate shape and including a central portion 25 which is advantageously concave to accommodate an oil sump formed at the bottom of the hermetic compressor volume and/or an oil pump attached to the lower end of the drive shaft 15.

The mounting base 24 has a generally rectangular shape, and for example a square shape, and includes four lateral outer edges 26.1, 26.2 and four downwardly bent flanges 27.1, 27.2 each extending from and along a respective one of the four lateral outer edges 26.1, 26.2.

The baseplate 6 further comprises a cylindrical rim 28 surrounding the central portion 25 and extending upwardly so that the cylindrical rim 28 upwardly protrudes from the mounting base 24. Particularly, the cylindrical rim 28 extends vertically and perpendicularly to an upper surface of the mounting base 24. Advantageously, the cylindrical rim 28 and the central portion 25 are concentrically arranged, and the cylindrical rim 28 and the midshell 4 are also concentrically arranged.

The cylindrical rim 28 is secured to the mounting base 24 by a double-welded T-joint 29. The double-welded T-joint 29 includes an inner welding seam 29.1 connecting an inner surface 28.1 of the cylindrical rim 28 to the mounting base 24, and an outer welding seam 29.2 connecting an outer surface 28.2 of the cylindrical rim 28 to the mounting base 24. Advantageously, the inner and outer welding seams 29.1, 29.2 are annular and concentrically arranged. Particularly, the diameter of the inner welding seam 29.1 corresponds substantially to the inner diameter of the cylindrical rim 28, and the diameter of the outer welding seam 29.2 corresponds substantially to the outer diameter of the cylindrical rim 28.

According to the embodiment shown on FIGS. 1 to 5, a lower end portion of the midshell 4 overlaps the inner surface 28.1 of the cylindrical rim 28 and is surrounded by the cylindrical rim. In other words, the inner surface 28.1 of the cylindrical rim 28 faces the outer surface of the lower end portion of the midshell 4.

Advantageously, the cylindrical rim 28 is secured to the midshell 4 by lap welding, and the scroll compressor 2 includes an annular lap joint welding seam 31 securing the midshell 4 to the cylindrical rim 28. Particularly, the annular lap joint welding seam 31 connects an upper edge of the cylindrical rim 28 to the outer surface of the lower end portion of the midshell 4, and the diameter of the annular lap joint welding seam 31 corresponds substantially to the outer diameter of the midshell 4.

According to an embodiment of the invention, the baseplate 6 may be configured to be mounted on two mounting rails 32 (see FIG. 5) extending substantially parallely to each other. The two downwardly bent flanges 27.1 are configured to extend substantially parallely to the two mounting rails 32, and the two downwardly bent flanges 27.2 are configured to extend transversally, and particularly perpendicularly, to the two mounting rails 32. Each downwardly bent flange 27.2 may for example only extends along a central part of the respective lateral outer edge 26.2 in order to define enlarged passages for the two mounting rails 32.

The mounting base 24 further comprises fastening holes 33 configured to accommodate fastening elements, e.g. bolts or screws, to secure the mounting base 24 on the mounting rails 32 or on a flat support surface.

Figure 6:
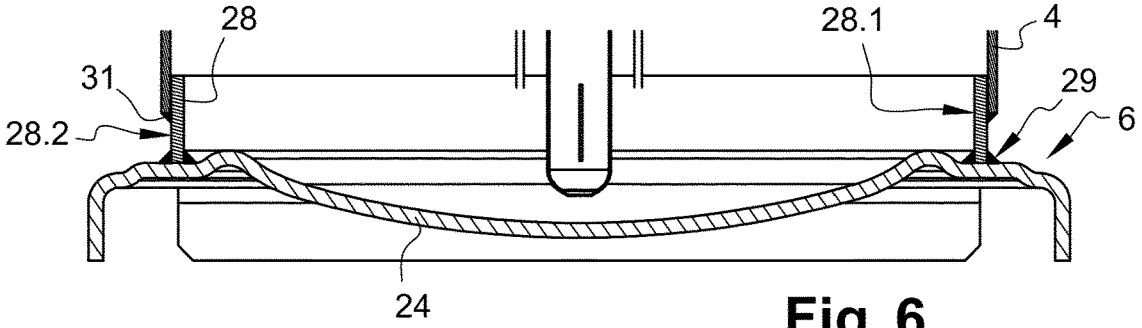
FIG. 6 is a partial longitudinal section view of a scroll compressor according to a second embodiment of the invention.

FIG. 6 represents a scroll compressor according to a second embodiment of the invention which differs from the first embodiment essentially in that the lower end portion of the midshell 4 overlaps and surrounds the outer surface 28.2 of the cylindrical rim 28, and in that the annular lap joint welding seam 31 connects a lower edge of the midshell 4 to the outer surface 28.2 of the cylindrical rim 28. According to said second embodiment, the diameter of the annular lap joint welding seam 31 corresponds substantially to the outer diameter of the cylindrical rim 28.

According to said second embodiment, an upper axial end face of the cylindrical rim 28 may abut against a lower axial end face of each bracket 23 so that the lower axial end face of each bracket 23 serves as a stop surface for the insertion of the baseplate 6 into the midshell 4. Such a configuration of the baseplate 6 allows mastering the vertical position of the baseplate 6 in the midshell 4 before welding the cylindrical rim 28 to the midshell 4, and thus eases the manufacturing of the scroll compressor 2.

Figure 7:
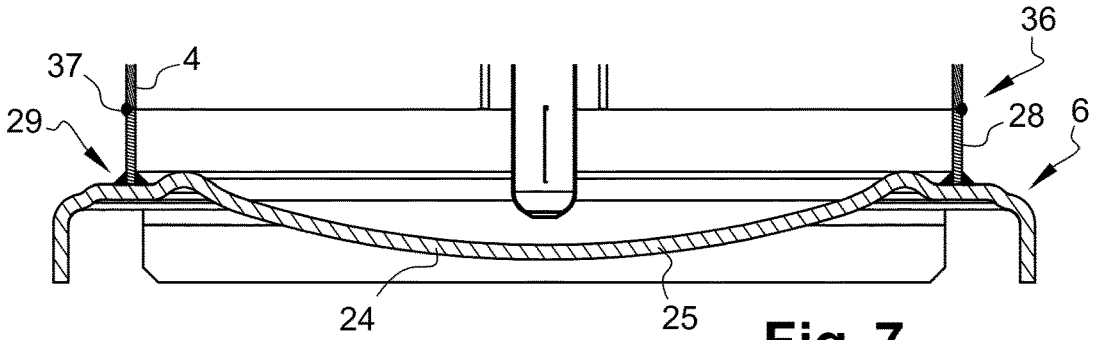
FIG. 7 is a partial longitudinal section view of a scroll compressor according to a third embodiment of the invention.

FIG. 7 represents a scroll compressor according to a third embodiment of the invention which differs from the first embodiment essentially in that the lower end portion of the midshell 4 has an outer diameter which corresponds to the outer diameter of the cylindrical rim 28, and in that the midshell 4 is secured to the cylindrical rim 28 by a welded butt joint 36, i.e. by butt welding.

The welded butt joint 36 includes an annular butt joint welding seam 37 connecting a lower edge of the midshell 4 to an upper edge of the cylindrical rim 28. The diameter of the annular butt joint welding seam 37 corresponds substantially to the outer diameter of the cylindrical rim 28.

Figure 8:
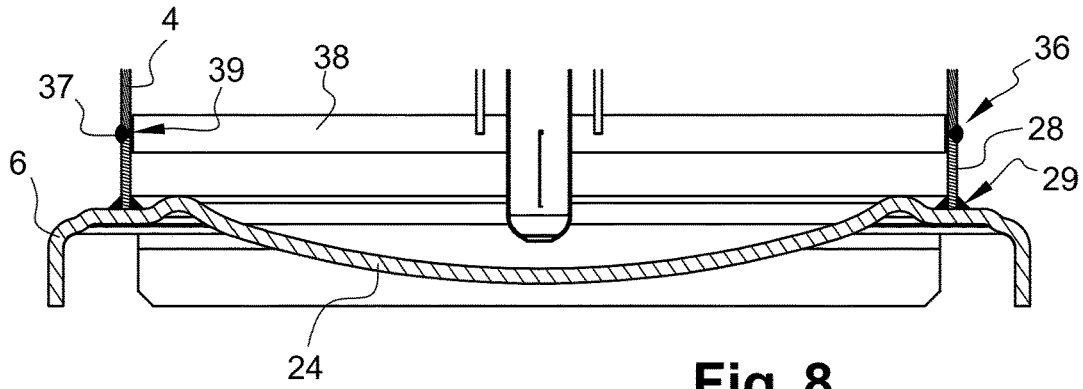
FIG. 8 is a partial longitudinal section view of a scroll compressor according to a fourth embodiment of the invention.

FIG. 8 represents a scroll compressor according to a fourth embodiment of the invention which differs from the third embodiment essentially in that the welded butt joint 36 further comprises an inner cylindrical support ring 38 arranged within the hermetic casing 3 and overlapping a butt joint area 39. The inner cylindrical support ring 38 particularly overlaps the lower end portion of the midshell 4 and the upper end portion of the cylindrical rim 28.

According to an embodiment not shown on the drawings, the mounting base 24, and for example the central portion 25 of the mounting base 24, may be provided with two indentations configured to cooperate with and to at least partially receive two mounting rails. Advantageously, the distance between the two indentations substantially corresponds to the distance between the mounting rails, and each indentation has a shape which is at least partially complementary to the outer shape of the respective mounting rail. Hereby, the same baseplate may be used for mounting a compressor on rails or on plain surfaces.

Of course, the invention is not restricted to the embodiments described above by way of non-limiting examples, but on the contrary it encompasses all embodiments thereof.

What is claimed is:

1. A scroll compressor comprising a hermetic enclosure, a compression unit configured to compress refrigerant, and an electric motor configured to drive the compression unit via a drive shaft, the hermetic enclosure comprising a midshell, an upper cap and a baseplate, the baseplate comprising a mounting base having a plate shape and including a central portion, wherein the baseplate further comprises a cylindrical rim surrounding the central portion and extending upwardly, the cylindrical rim being secured to the mounting base by a double-welded T-joint, the double-welded T-joint including an inner welding seam connecting an inner surface of the cylindrical rim to the mounting base, and an outer welding seam connecting an outer surface of the cylindrical rim to the mounting base.

2. The scroll compressor according to claim 1, wherein the cylindrical rim extends substantially perpendicularly to an upper surface of the mounting base.

3. The scroll compressor according to claim 1, wherein each of the inner welding seam and the outer welding seam is annular.

4. The scroll compressor according to claim 1, wherein the cylindrical rim is secured to the midshell by welding.

5. The scroll compressor according to claim 4, wherein a lower end portion of the midshell overlaps and surrounds the outer surface of the cylindrical rim.

6. The scroll compressor according to claim 4, wherein a lower end portion of the midshell overlaps the inner surface of the cylindrical rim and is surrounded by the cylindrical rim.

7. The scroll compressor according to claim 4, wherein the midshell has an outer diameter which corresponds substantially to an outer diameter of the cylindrical rim, the midshell being secured to the cylindrical rim by a welded butt joint.

8. The scroll compressor according to claim 7, wherein the welded butt joint comprises an inner cylindrical support ring arranged within the hermetic casing and overlapping a butt joint area.

9. The scroll compressor according to claim 1, wherein the central portion of the mounting base has a concave shape to accommodate an oil sump formed at the bottom of the hermetic compressor volume and/or an oil pump attached to the lower end of the drive shaft.

10. The scroll compressor according to claim 1, wherein the mounting base has a generally rectangular shape and includes four lateral outer edges and four downwardly bent flanges each extending from and along a respective one of the four lateral outer edges.

11. The scroll compressor according to claim 1, wherein the baseplate is configured to be mounted on two mounting rails extending substantially parallel to each other.

12. The scroll compressor according to claim 11, wherein the mounting base further comprises fastening holes to accommodate fastening elements to secure the mounting base on the mounting rails.

13. The scroll compressor according to claim 1, further comprising at least one bracket secured to an inner surface of the midshell and configured to support a lower bearing member rotatably supporting the drive shaft.

14. The scroll compressor according to claim 13, wherein an upper axial end face of the cylindrical rim abuts against the at least one bracket.

15. The scroll compressor according to claim 2, wherein each of the inner welding seam and the outer welding seam is annular.

16. The scroll compressor according to claim 2, wherein the cylindrical rim is secured to the midshell by welding.

17. The scroll compressor according to claim 3, wherein the cylindrical rim is secured to the midshell by welding.

18. The scroll compressor according to claim 2, wherein the central portion of the mounting base has a concave shape to accommodate an oil sump formed at the bottom of the hermetic compressor volume and/or an oil pump attached to the lower end of the drive shaft.

19. The scroll compressor according to claim 3, wherein the central portion of the mounting base has a concave shape to accommodate an oil sump formed at the bottom of the hermetic compressor volume and/or an oil pump attached to the lower end of the drive shaft.

20. The scroll compressor according to claim 4, wherein the central portion of the mounting base has a concave shape to accommodate an oil sump formed at the bottom of the hermetic compressor volume and/or an oil pump attached to the lower end of the drive shaft.

* * * * *